US007431869B2

(12) United States Patent
Haggard et al.

(10) Patent No.: US 7,431,869 B2
(45) Date of Patent: Oct. 7, 2008

(54) METHODS OF FORMING ULTRA-FINE FIBERS AND NON-WOVEN WEBS

(75) Inventors: Jeff Haggard, Cocoa, FL (US); Arnold Wilkie, Merritt Island, FL (US); James Brang, Cocoa, FL (US); Jerry Taylor, West Melbourne, FL (US)

(73) Assignee: Hills, Inc., West Melbourne, FL (US)

( * ) Notice: Subject to any disclaimer, the term of this patent is extended or adjusted under 35 U.S.C. 154(b) by 21 days.

(21) Appl. No.: 10/860,565

(22) Filed: Jun. 4, 2004

(65) Prior Publication Data

US 2005/0032450 A1 Feb. 10, 2005

Related U.S. Application Data

(60) Provisional application No. 60/475,484, filed on Jun. 4, 2003, provisional application No. 60/480,221, filed on Jun. 23, 2003.

(51) Int. Cl.

| | |
|---|---|
| ***D01D 5/34*** | (2006.01) |
| ***D01D 5/36*** | (2006.01) |
| ***D01F 9/145*** | (2006.01) |
| ***D01F 9/22*** | (2006.01) |
| ***D02G 3/02*** | (2006.01) |

(52) U.S. Cl. ..... 264/29.2; 264/172.13; 264/172.15; 264/211.16

(58) Field of Classification Search ..... 264/29.2, 264/103, 172.13, 172.15, 211.16, 555; 156/167, 156/181

See application file for complete search history.

(56) References Cited

U.S. PATENT DOCUMENTS 3,716,614 A * 2/1973 Okamoto et al. .... 264/172.13 X
3,802,817 A * 4/1974 Matsuki et al. ..... 264/555 X
4,176,211 A 11/1979 Jackson
4,351,337 A 9/1982 Sidman
4,381,335 A * 4/1983 Okamoto ..... 264/172.13 X
4,557,972 A * 12/1985 Okamoto et al. .... 264/172.13 X
4,810,571 A 3/1989 Guthrie
4,861,661 A 8/1989 Samuelson
5,137,969 A 8/1992 Marten et al.
5,149,517 A 9/1992 Fain et al.
5,162,074 A 11/1992 Hills
5,688,468 A 11/1997 Lu (Continued)

*Primary Examiner*—Leo B Tentoni
(74) *Attorney, Agent, or Firm*—Edell, Shapiro & Finnan, LLC

(57) ABSTRACT

A nonwoven web product including ultra-fine fibers is formed utilizing a spunbond apparatus that forms multicomponent fibers by delivering first and second polymer components in a molten state from a spin pack to a spinneret, extruding multicomponent fibers including the first and second polymer components from the spinneret, attenuating the mulicomponent fibers in an aspirator, laying down the multicomponent fibers on an elongated forming surface disposed downstream from the aspirator to form a nonwoven web, and bonding portions of at least some of the fibers in the nonwoven web together to form a bonded, nonwoven web product. The multicomponent fibers can include separable segments such as islands-in-the-sea fibers, where certain separated segments become the ultra-fine fibers in the web product. In addition, carbon tubular fibers can be formed by extruding island-in-the-sea fibers including polyacrylonitrile or pitch sheath segments in the fibers, separating the segments of the fiber, and converting the polyacrylonitrile of pitch to carbon by a carbonization process.

6 Claims, 2 Drawing Sheets

U.S. PATENT DOCUMENTS

| | | | | |
|---|---|---|---|---|
| 5,814,349 | A | 9/1998 | Geus et al. | |
| 6,113,722 | A | 9/2000 | Hoffman et al. | |
| 6,117,802 | A | 9/2000 | Rohrbach et al. | |
| 6,387,492 | B2 | 5/2002 | Soane et al. | |
| 6,440,556 | B2 | 8/2002 | Matsui et al. | |
| 6,444,312 | B1 | 9/2002 | Dugan | |
| 6,455,156 | B1 | 9/2002 | Tanaka et al. | |
| 6,583,075 | B1 | 6/2003 | Dugan | |
| 6,737,009 | B2 * | 5/2004 | Taylor et al. | 264/555 |
| 6,770,580 | B2 | 8/2004 | Bevans | |
| 6,861,142 | B1 * | 3/2005 | Wilkie et al. | 428/373 |
| 6,884,378 | B2 * | 4/2005 | Jen | 264/172.13 |
| 7,025,915 | B2 * | 4/2006 | Wang et al. | 264/103 |

* cited by examiner

METHODS OF FORMING ULTRA-FINE FIBERS AND NON-WOVEN WEBS

CROSS REFERENCE TO RELATED APPLICATION

This application claims priority from: U.S. Provisional Patent Application Ser. No. 60/475,484 entitled "Ultra-fine Fiber Spunbond Webs using Islands-in-the Sea Technology," and filed Jun. 4, 2003; and U.S. Provisional Patent Application Ser. No. 60/480,221 entitled "Carbon Nanofibers Based on Islands-in-a-Sea Multi-filament Technology," and filed Jun. 23, 2003. The disclosures of these provisional patent applications are incorporated herein by reference in their entireties.

BACKGROUND OF THE INVENTION

1. Field of the Invention

The present invention relates to methods and apparatus for producing ultra-fine fibers and ultra-fine webs of fibers utilizing a spunbond process.

2. Description of the Related Art

The spunbond process, a direct one-step method to manufacture fabric from polymer materials utilizing a spin and bond method, was first commercialized by DuPont Corporation in 1959 with the formation of a polyester nonwoven product sold under the trademark REEMAY®. In the half century since much progress has been made in the spunbond process, with many different products available based upon the selection of one or more polymers to be used in the process. The global growth rate for spunbond products has increased considerably over this period of time, higher than any other nonwoven technology, and suppliers of medical and hygiene products have switched almost completely to spunbond or spunbond composites.

The fiber fineness or size produced in a spunbond process is typically greater than about 1.0 denier, despite the efforts of spunbond developers to produce sub-denier products economically. The term "denier" refers to the mass in grams per 9,000 meters of fiber. In particular, it is presently very difficult to obtain spunbond fabrics having a fineness in the range of about 0.5 dpf (denier per fiber) or less due to production, economic, and various technical factors associated with spunbond processes.

To obtain the benefits of finer fibers, and smaller pore size for nonwoven fabrics formed with such fibers, manufacturers have resorted to using meltblown processes to form fibers with smaller dimensions for use in manufacturing fabrics. Generally, a meltblown process differs from a spunbond process in that extruded polymer filaments, upon emerging from an extruder die, are immediately blown with a high velocity, heated medium (e.g., air) onto a suitable support surface. In contrast, extruded but substantially solidified filaments (e.g., utilizing a suitable quenching medium such as air) in a spunbond process are drawn and attenuated utilizing a suitable drawing unit (e.g., an aspirator or godet rolls) prior to being laid down on a support surface. Meltblown processes are typically utilized in forming fibers having diameters on a micron level, whereas spunbond processes are typically employed to produce fibers having normal textile dimensions.

To date, manufacturers have produced laminates including three or more nonwoven layers, where a layer of meltblown microfibers (including fibers with average diameters or average cross-sectional dimensions in the range of 2-4 micrometers or microns) is sandwiched between two layers of macrofiber spunbond products. An example of such a laminate is described in U.S. Pat. No. 4,810,571, the disclosure of which is incorporated herein by reference in its entirety. Laminates such as these are referred to as "SMS" laminates (i.e., referring generally to any combination of one or more meltblown layers sandwiched between two or more spunbond layers, such as spunbond-meltblown-spunbond, spunbond-meltblown-meltblown-spunbond, spunbond-spunbond-meltblown-spunbond-spunbond, etc.). The meltblown layer must be sandwiched between spunbond layers, since the tenacity of meltblown fibers is not very large in comparison to spunbond fibers.

From a performance standpoint, SMS laminates have performed better than traditional spunbond fabrics and are satisfactory in certain applications. However the investment cost to produce such laminates is quite high due to the requirement of having spunbond layers surrounding meltblown layers. In addition, the meltblown portion of the fabric has low orientation with resulting low tensile properties. The meltblown layer can also be relatively amorphous depending on the polymer used to form the meltblown fibers. Further, the size distribution of meltblown fibers is significantly broad, such that meltblown fabric layers often include a significant percentage of larger fibers having diameter dimensions that are 100% or greater in comparison to the average fiber dimensions of the fabric.

Fabric performance could be enhanced, particularly in areas such as filtration, fabric drape, softness, and coverage, if fabrics could be formed with fibers as fine or finer than the meltblown fibers that are substantially uniform in cross-sectional dimensions and have tensile and crystalline properties of spunbond fibers.

Another problem in spunbond processes that produce complex plural component fibers (e.g., bicomponent fibers) is that it has been necessary to arrange multiple small spin packs and drawing units together in a direction transverse the web laydown and travel direction in order to achieve a resultant nonwoven fabric from the drawn fibers that is at least of sufficient width (e.g., 500 millimeters or greater in width). This in turn contributes to problems in uniformity of the fabric laydown.

A further problem for both spunbond and meltblown processes is the difficulty in producing hollow or tubular nanofibers of sufficient dimensions (e.g., between about 500 nanometers or less in diameter). In particular, it is desirable to produce carbon nanofibers from an extrusion process for a variety of different applications. Carbon fibers are lightweight and have extremely high strength characteristics that make them useful in forming a number of different products, such as fishing rods, tennis rackets shafts for golf clubs, rigid components for automobiles and aircraft, etc. In addition, hollow carbon nanofibers hold great promise for use in engineering and medical devices such as artificial kidneys and other organ transplants, microfiltration devices, etc.

It is known to manufacture carbon nanofibers by extruding melt processable polyacrylonitrile (PAN) in a spunbond or meltblown process, followed by subjecting the extruded PAN fibers to a carbonization process to form carbon fibers. One example of such a process is described in U.S. Pat. No. 6,583,075, which is incorporated herein by reference in its entirety. In particular, the '075 patent describes the formation of multicomponent fibers (e.g., pie/wedge fibers, islands-in-the-sea fibers, etc.), in which one component is PAN and the other component is dissolvable from PAN, such that PAN microfibers can be formed from the multicomponent fiber, and the PAN microfibers are then converted to graphite fibers in a carbonization process.

While processes have been developed to form extruded PAN microfibers that can be converted to carbon microfibers, difficulties still exist in attempting to form an extruded hollow PAN tube on the order of micron or even nanometer diameter dimensions. This is due, in part, to the difficulty associated with extruding a hollow fiber on the micron or nanometer diameter dimensions without having collapsing or deforming, either by the surface tension of the solidifying fiber or the tension applied to the fiber, after extrusion. In addition, typical extrusion processes simply cannot achieve sufficient productivity levels for generating hollow microfibers that renders the process efficient and economical. Accordingly, a need exists to reliably and efficiently manufacture hollow PAN tubular fibers on micron or nanometer dimensions that can then be converted to carbon tubes.

SUMMARY OF THE INVENTION

In accordance with the present invention, a method of forming a nonwoven web product including ultra-fine fibers includes delivering first and second polymer components in a molten state from a spin pack to a spinneret, extruding multicomponent fibers including the first and second polymer components from the spinneret, attenuating the multicomponent fibers in an aspirator, laying down the multicomponent fibers on an elongated forming surface disposed downstream from the aspirator to form a nonwoven web, and bonding portions of at least some of the fibers in the nonwoven web together to form a bonded, nonwoven web product. The multicomponent fibers can include separable segments such as islands-in-the-sea fibers, where certain separated segments become the ultra-fine fibers in the web product.

In another embodiment of the present invention, an apparatus for producing a nonwoven web product including ultra-fine fibers includes a spin pack to receive and process at least first and second polymer components in a molten state, and a spinneret located downstream from the spin pack and including a plurality of orifices to receive the first and second polymer components in the molten state. The spinneret extrudes multicomponent fibers including the first and second polymer components from the spinneret orifices. The apparatus further includes an aspirator disposed downstream from the spinneret and configured to receive and attenuate the extruded multicomponent fibers, and an elongated forming surface disposed downstream from the aspirator and configured to receive the attenuated multicomponent fibers to form a nonwoven web. Each of the spinneret and the aspirator include a full fabric width dimension of at least about 500 millimeters, and the full fabric width dimension is transverse the orientation of the forming surface.

In yet another embodiment of the present invention, a nonwoven web product includes a plurality of ultra-fine fibers having a transverse cross-sectional dimension that is no greater than about five micrometers (microns), where the transverse cross-sectional dimension of each ultra-fine fiber is within about 50% of an average or predetermined value.

In still another embodiment, a method of forming fibers includes delivering first and second polymer components in a molten state from a spin pack to a spinneret, where the first polymer component includes at least one polymer that is at least partially dissolvable in a dissolving medium and the second polymer component includes polyacrylonitrile or pitch. Fibers are extruded from the spinneret including the first and second polymer components, where at least some of the fibers include islands-in-the-sea fibers. Each islands-in-the-sea fiber includes island segments disposed within a sea section, the sea sections of the islands-in-the-sea fibers include the first polymer component, and at least some of the island segments include sheath-core segments. The sheath-core segments include a sheath section including the second polymer component surrounding a core section including the first polymer component. The sea sections and core segments are separated from the sheath segments of islands-in-the-sea fibers to form tubular fibers from the sheath segments. The sheath segments, which include polyacrylonitrile or pitch, are then subjected to a carbonization process to form carbon tubular fibers.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DESCRIPTION OF THE PREFERRED EMBODIMENTS

Figure 1A:
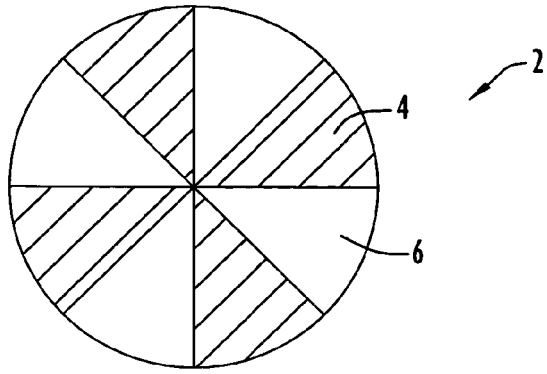
FIGS. 1*a*-1*c* are transverse cross-sectional views of exemplary embodiments of multicomponent fibers in accordance with the present invention.

The present invention overcomes the previously noted problems associated with producing a substantially uniform distribution of ultra-fine spunbond fibers having suitable transverse cross-sectional dimensions on the micron or nanometer scale. The present invention further provides a system that produces fabrics or other nonwoven web products of sufficient widths including ultra-fine spunbond fibers that exhibit enhanced look, feel and drape characteristics. In addition, the present invention provides a system and corresponding methods for producing a carbon nanotube or tubular fiber utilizing a melt extrusion process. The term "transverse cross-sectional dimension", as used herein in relation to a fiber or filament, refers to the dimension of the fiber in a direction that is transverse its longitudinal dimension (e.g., the diameter for a round fiber).

The ultra-fine fibers are produced by extruding multicomponent fibers (i.e., a fiber including at least two different polymer components or the same polymer component with different viscosity and/or other physical property characteristics) in a spunbond system, where each fiber includes segments that are separable from each other. In a preferred embodiment, the fiber includes a first segment including a first polymer component that is at least partially soluble or dispersible in a solvent or dissolving medium (e.g., an aqueous solution) and a second segment including a second polymer component that is substantially insoluble in the solvent.

Exemplary first polymer (e.g., partially or completely dissolvable) components include, without limitation, polyethylene terephthalate modified with a sulfonated isocyanate and commonly referred to as easy soluble polyester or ESPET (soluble in sodium hydroxide and commercially available from Kuraray Co., LTD., Osaka, Japan), a water dispersible polyester such as AQ65 commercially available under the trade name Eastek 1200 from Eastman Chemical Company (Kingsport, Tenn.), polystyrene (soluble in organic solvents);

polyvinyl alcohol or PVA (soluble in water); ethylene vinyl alcohol or EVOH (soluble in water); polyethylene oxide (soluble in water); polyacrylamide (soluble in water); poly (lactic) acid or PLA (soluble in alkali solution); other water soluble copolyester resins (e.g., those described in U.S. Pat. No. 5,137,969, the disclosure of which is incorporated herein by reference in its entirety), copolymers, terpolymers, and mixtures thereof.

Exemplary second polymer components include, without limitation, polyesters such as polyethylene terephthalate (PET), polyethylene naphthalate (PEN), polytrimethylene terephthalate (PTT) and polybutylene terephthalate (PBT); polyurethanes; polycarbonates; polyamides such as Nylon 6, Nylon 6,6 and Nylon 6,10; polyolefins such as polyethylene and polypropylene; polyacrylonitrile (PAN); and any combinations thereof. Generally, any polymer combination in the fiber may be utilized that facilitates separation of the second polymer component from the first polymer component by dissolution of the first polymer component when the fiber is exposed to one or more dissolving mediums, thus yielding an ultra-fine fiber that can be used to form a nonwoven fabric or other types of products.

Any suitable fiber dimension can be utilized that facilitates the dissociation or separation of the extruded fiber into at least one segment or filament that has sufficient transverse cross-sectional dimensions that are in the micron or nanometer range. Preferably, the filaments or ultra-fine fibers formed after dissociation of the multicomponent fiber have transverse cross-sectional dimensions that are no greater than about 10 microns, more preferably no greater than about 5 microns, and most preferably no greater than about 2 microns. In particular, ultra-fine filaments can be formed that have transverse cross-sectional dimensions that are no in the range of 0.5 microns or 500 nanometers to 100 nanometers or less.

In addition, the transverse cross-sectional dimensions of all of the filaments formed after dissociation of the fiber are substantially uniform. In particular, the transverse cross-sectional dimension of each of the ultra-fine fibers is preferably within about 50% of an average or predetermined value, more preferably is within about 25% of an average or predetermined value, and most preferably is within about 10% of an average or predetermined value. For example, if the predetermined value for the ultra-fine fibers is 2 microns in diameter, each ultra-fine fiber can be formed to fall within about 10% of 2 microns, such that ultra-fine fibers will be formed that are no smaller than about 1.8 microns in diameter and no larger than about 2.2 microns in diameter.

Examples of suitable multicomponent fiber cross-sections that can be separated to form ultra-fine fibers include, without limitation, segmented pie shaped fibers (e.g., refer to FIG. 1A), islands-in-the-sea or I/S fibers (e.g., refer to FIGS. 1B and 1C), segmented multilobal fibers, segmented rectangular or ribbon-shaped fibers, etc.

In one embodiment depicted in FIG. 1A, a generally circular segmented pie shaped fiber 2 includes a series of alternating and generally triangular first segments 4 and second segments 6, where the first segments 4 include a dissolvable first polymer component (such as any of the types described above) and the second segments 6 include a substantially non-dissolvable second polymer component (such as any of the types described above). The first segments can be dissociated from the second segments when exposed to a suitable dissolving medium to yield ultra-fine fibers as defined by the second segments. The arrangement and number of first and second pie segments in the fiber 2 can be selected so as to increase the number and yield of ultra-fine fibers per fiber. Further, the transverse cross-sectional dimensions of the segmented pie fibers, the number of segments per fiber and/or the ratio or size of dissolvable pie segments to insoluble pie segments can be selected to yield ultra-fine fibers of a selected denier for a particular application.

Figure 1B:
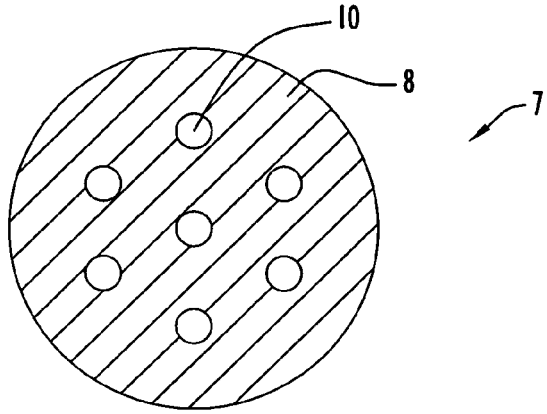
Figure 1C:
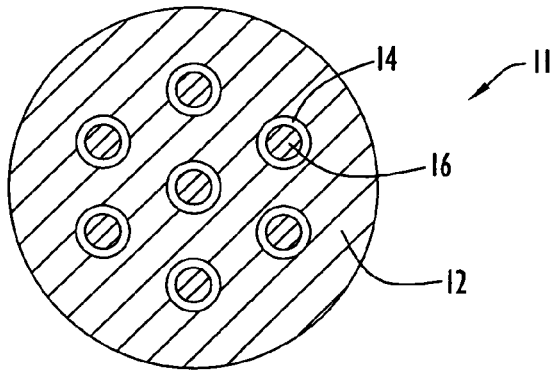

In another embodiment, I/S fibers are extruded so as to form island segments within sea segments that have selected and substantially uniform cross-sectional dimensions to facilitate the formation of ultra-fine filaments for use in forming nonwoven fabrics or ultra-fine nanotube fibers as described below. In the embodiment of FIG. 1B, a generally circular I/S fiber 7 is depicted including a sea section 8 formed with a dissolvable first polymer component (such as any of the types described above) and a series of island segments 10 disposed within the sea section 8 and formed with a substantially insoluble second polymer component (such as any of the types described above). The island segments extend the longitudinal dimension of the fiber. Upon subjecting the I/S fiber 7 to a suitable dissolving medium, the sea section 8 is dissolved away to yield ultra-fine filaments formed from the remaining island segments 10. While the I/S fiber depicted in FIGS. 1B and 1C are circular in transverse cross-section, it is noted that I/S fibers can be formed with any suitable transverse cross-sectional geometry including, without limitation, square, triangular, multifaceted, multi-lobed, elongated, etc.

Ultra-fine filaments or fibers produced from I/S fibers in the manner described above yields a spunbond fabric with desirable drape and strength qualities that are a significant improvement over fabrics made with meltblown fiber layers (e.g., SMS fabrics). It is noted that the number of island segments in the fiber 7 of FIG. 1B is for illustrative purposes only, and any suitable number of island segments can be provided in the sea section of the fiber. In particular, I/S fibers can be formed with island segments ranging from at least two island segments in the sea section, preferably eight or more island segments in the sea section, and more preferably 35 or more island segments in the sea section. In certain situations, depending upon the size and number of ultra-fine fibers that are required for a particular application, I/S fibers can be formed that include several hundreds (e.g., 600 or more) or even thousands of island segments in the sea section.

The sea section can make up any portion of the I/S fiber. For example, the sea section can make up from about 5% by weight to about 95% by weight of each I/S fiber. However, since the sea section for an I/S fiber of the present invention is dissolvable and is thus sacrificial, it is preferable to form the I/S fibers such that the sea section forms no greater than about 20-30% by weight of each fiber.

Island segments can have any suitable transverse cross-sectional dimensions that are desirable for forming ultra-fine fibers for a particular end use. For example, ultra-fine fibers can be formed with transverse cross-sectional dimensions of no greater than about 5 microns, preferably no greater than about 1 micron, and more preferably no greater than about 0.5 micron or 500 nanometers. In particular, ultra-fine fibers can be formed in accordance with the present invention that have transverse cross-sectional dimensions on the order of about 500 nanometers to about 100 nanometers or less. As noted above, the transverse cross-sectional dimensions of the ultra-fine fibers are substantially uniform, unlike meltblown fibers. Thus, a spunbond fabric can be formed with the ultra-fine fibers obtained from I/S fibers (with the sea sections dissolved away) in which transverse cross-sectional dimension of each of the ultra-fine fibers is preferably within about 50% of an average or predetermined value, more preferably is within about 25% of an average or predetermined value, and most preferably is within about 10% of an average or predetermined value.

Further, the tensile properties or tenacity of the ultra-fine fibers formed from the I/S fibers are much greater than melt-blown fibers, being on the order of about 1 gram/denier or greater. Thus, the ultra-fine fiber dimensions yield a spunbond fabric with superior tenacity, fineness, drape, and other characteristics. For example, spunbond fabrics formed with such ultra-fine fibers can have a fineness on the order of about 0.5 dpf (denier per fiber) or less.

Tubular fibers, such as carbon nanotube fibers, can be formed by extruding I/S fibers where the island segments include a sheath-core configuration as depicted in FIG. 1C. In particular, a generally circular I/S fiber 11 includes a sea section 12 and a series of longitudinally extending island segments, where each island segment includes a longitudinally extending internal component or core 16 at least partially surrounded along its longitudinal periphery by at least one longitudinally extending cover or sheath 14. It is noted that the core of any one or more island segments within the I/S fiber may be concentric or, alternatively, eccentric, with respect to its sheath. The sea section and/or cores 12 and 16 include one or more dissolvable first polymer components (such as any of the types described above), where the dissolvable polymer component of each core 12 may be the same or different from the dissolvable polymer component of the sea section 12. The sheath 14 of each island segment includes a substantially insoluble second polymer component (such as any of the types described above). Dissociation of the sea section 12 and/or cores 16 from the sheath 14 can thus be achieved by exposing the fiber 11 to one or more suitable dissolving mediums, yielding hollow or tubular fibers having suitable transverse cross-sectional dimensions on the micron or nanometer scale. For example, tubular fibers can be formed having transverse cross-sectional dimensions no greater than about 5 microns and as small as about 100 nanometers or less.

As noted above, polyacrylonitrile (PAN) can be utilized as the second polymer component to form the sheath in the I/S fibers including sheath/core island sections. Alternatively, or in addition to PAN, pitch may be utilized to form the sheath in the I/S fibers. Upon dissolution of the sea section and/or cores, a select number of PAN or pitch tubular fibers are formed that can be converted to carbon tubular fibers or nanotubes upon subjecting the PAN or pitch fibers to a suitable carbonization process. Melt processable PAN or pitch is utilized to form molten PAN that can be extruded as the sheath sections in the I/S fibers. An example of melt processable PAN suitable for use in forming PAN I/S fibers is described in U.S. Pat. No. 6,444,312, the disclosure of which is incorporated herein by reference in its entirety, and an example of a carbonizable pitch suitable for use in forming pitch I/S fibers is A-340 pitch material available from Marathon Ashland Petroleum (Houston, Tex.), or an equivalent grade available from ConocoPhillips (Houston, Tex.).

Carbonization of the PAN or pitch tubular fibers can be performed in a conventional or any other suitable manner. Carbonization is generally performed by heating the PAN or pitch fibers at temperatures ranging from about 600° C. to about 2000° C. in a furnace or chamber and under an inert, non-oxidizing atmosphere such as nitrogen. This heating drives off or removes non-carbon elements and/or generates char material that can be removed from the fiber so as to yield an amorphous carbon fiber. The fiber can further be subjected to a heat treatment in excess of 2500° C. to yield a carbon fiber having a graphite-like chemical structure. The carbon tubular fibers or nanotubes (if produced on nanometer dimensions) can be used for a number of different applications, including, e.g., engineering and medical devices such as artificial kidneys and other organ transplants, microfiltration devices, etc.

When forming carbon nanotubes, the core segments of the sheath/core I/S fibers can include a dissolvable first polymer component (e.g., any of the types described above) or, alternatively, a second polymer component (e.g., any of the types described above) that is substantially insoluble in the dissolving medium used to separate the sea sections from the island segments of the fibers. For example, in one embodiment, both the core segments and the sea sections include a first polymer component that is dissolvable in a dissolving medium (where the core segments may or may not include the same dissolvable polymer as the sea sections). In this embodiment, the sheath sections, which include PAN or pitch, can be separated from the sea sections and core segments prior to carbonization. In another embodiment, the core segments include a second polymer component (e.g., polypropylene) that remains substantially insoluble when the fibers are exposed to a dissolving medium. The sheath/core islands can then be heat treated in a carbonization process. In certain situations, and depending upon the type of polymer component utilized for the cores, the second polymer component may form char material which may be separable from the carbon sheaths after carbonization.

Figure 2:
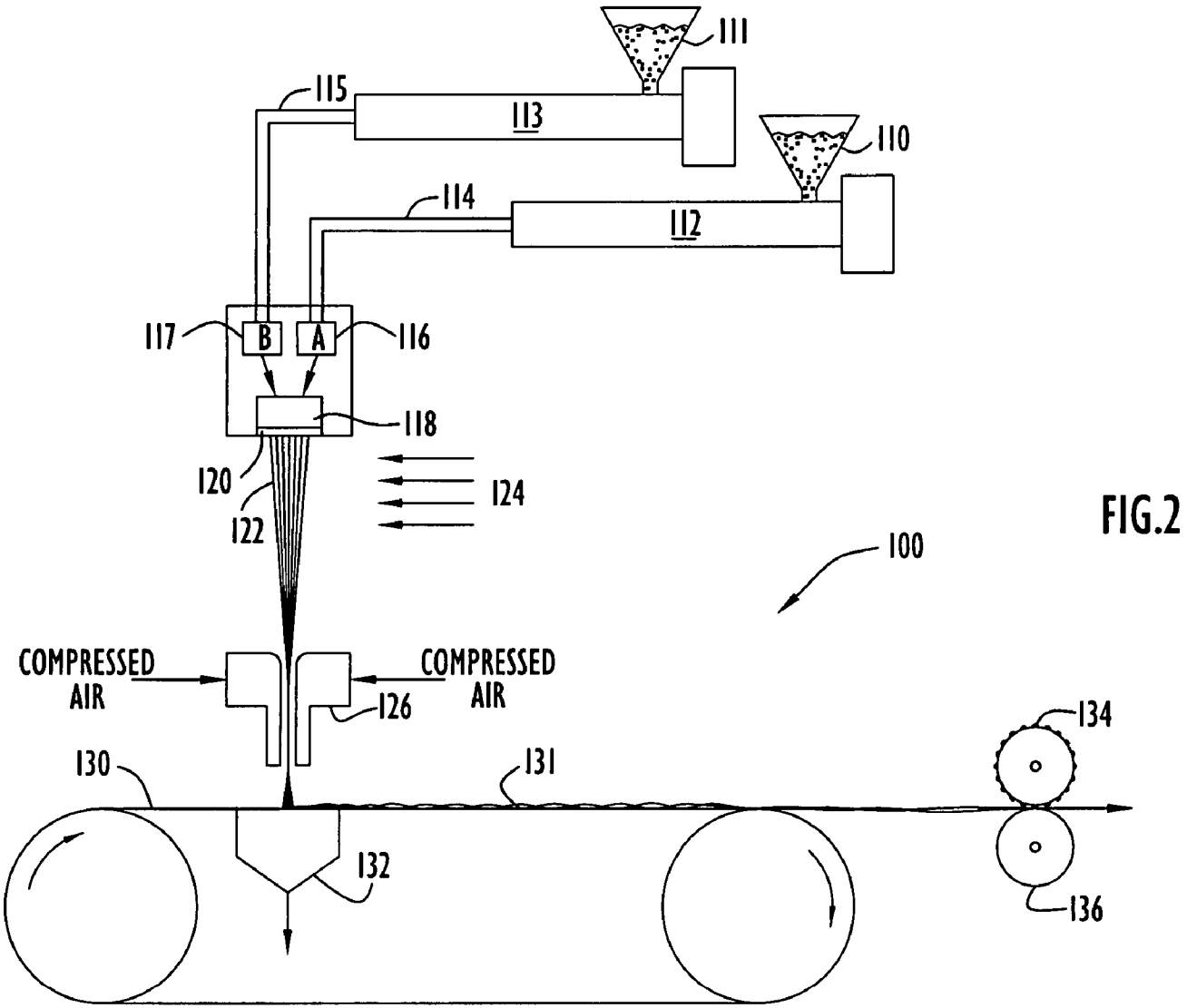
FIG. 2 is a diagrammatic view of a spunbond system for forming multicomponent fibers in accordance with the present invention.

An exemplary spunbond process that may be utilized to form fabrics with multicomponent fibers (e.g., I/S fibers) of the present invention is illustrated in the schematic of FIG. 2. System 100 includes a first hopper 110 into which pellets of a polymer component A are placed, where polymer component A includes a first polymer component as described above that is at least partially soluble in a dissolving medium. The polymer is fed from hopper 110 to screw extruder 112, where the polymer is melted. The molten polymer flows through heated pipe 114 into metering pump 116 and spin pack 118. A second hopper 111 feeds a polymer component B into a screw extruder 113, which melts the polymer. The polymer component B includes at least one of the second polymer components described above and is substantially insoluble in the dissolving medium. The molten polymer flows through heated pipe 115 and into a metering pump 117 and spin pack 118. In an exemplary embodiment, polymer component A includes a water dispersible polyester, such as AQ65 commercially available under the trade name Eastek 1200 from Eastman Chemical Company (Kingsport, Tenn.), to form the sea sections of an I/S fiber including sheath-core islands, whereas polymer component B includes a polyester (e.g., PET) composition to form the island segments.

The spin pack 118 includes a spinneret 120 with orifices through which islands-in-the-sea fibers 122 are extruded. The design of the spin pack is configured to accommodate multiple polymer components for producing any of the previously noted islands-in-the-sea or other fiber configurations including any desirable transverse cross-sectional geometries for fibers as well as the island components. A suitable spin pack that may be utilized with the system of the present invention is described in U.S. Pat. No. 5,162,074, the disclosure of which is incorporated herein by reference in its entirety. The extrusion spin pack of the '074 patent utilizes a thin distribution plate technology that, e.g., permits extrusion of multiple islands-in-the-sea fibers with over 2000 islands per I/S fiber. In addition, the spinneret is suitably designed to include a suitable hole density preferably in the range of at least about 1500 orifices or holes per meter of the spinneret. This ensures a suitable number of fibers are extruded to in turn yield a sufficient number of ultra-fine fibers for forming the nonwoven fabric.

The extruded fibers 122 emerging from the spinneret are quenched with a quenching medium 124 (e.g., air), and are subsequently directed into a high speed slot shaped aspirator 126, which draws and attenuates the fibers using compressed air. A portion of the quench air and some of the surrounding ambient room air become entrained with the fibers as they flow from the spinneret into the aspirator. Alternatively, it is noted that godet rolls or any other suitable drawing unit may be utilized to attenuate the fibers. The extruded fibers exit the aspirator along with a substantial volume of entrained air, including air introduced in the aspirator.

Upon exiting the aspirator 126, the drawn fibers are deposited or laid down as a web 131 onto a foraminous surface 130 (e.g., a continuous screen belt) and are collected and/or subjected to further conventional or other processing treatments (e.g., bonding, heat treatment, etc.). A suction device 132 positioned below the foraminous surface draws in and exhausts a substantial portion of the air entrained with the filaments arriving at the foraminous surface.

The system shown in FIG. 2 is a so-called open system. However, the ultra-fine fibers can also be produced in a so-called closed system spunbond process. In a closed system process, the filament draw is produced by quench air which is forced along with the fibers into a draw slot below the quench. An example of such a system is disclosed in U.S. Pat. No. 5,814,349, the disclosure of which is incorporated herein by reference in its entirety.

Preferably, the spinneret and slot shaped aspirator of the system 100 are sufficiently dimensioned in a direction that is transverse the travel direction of the laid down nonwoven web of fibers and the orientation of the foraminous surface so as to produce a full fabric width nonwoven web product without the need to combine additional spinnerets and aspirators in the direction transverse the lay down direction of the nonwoven web. The term "full fabric width dimension", as used herein, refers to the dimension of each of the spinneret and aspirator in a direction that is transverse the orientation of a forming surface for the nonwoven web. Preferably, the spinneret and aspirator include a full fabric width dimension of at least about 500 millimeters. In certain applications, the spinneret and aspirator include length dimensions of about 5.4 meters to accommodate full fabric width lay down without the need for additional, side-by-side spinnerets and aspirator units. In addition, the system can operate at spinning speeds of about 4,000 meters per minute (MPM) or more, with an aspirator that operates at speeds of about 6,000 MPM or more.

The nonwoven web may be subjected to additional bonding and/or finishing operations including, without limitation, calendar bonding, through-air bonding, chemical bonding, hydro-entangling, fiber splitting, needle punching, finish application, lamination, coating, and slitting and winding. In the embodiment of FIG. 2, calendar rolls 134 and 136 are provided to calendar bond form a loosely bonded nonwoven fabric.

The fibers can be subjected to one or more dissolving mediums (e.g., by submersion in the dissolving medium) at any suitable one or more locations during processing of the nonwoven web to facilitate dissociation of the multicomponent fibers into fiber segments that become the ultra-fine fibers in the nonwoven web. For example, the I/S fibers such as the types described above can be extruded in a spunbond process and laid down on a forming surface and bonded to form a nonwoven fabric prior to exposing the fabric to a dissolving medium. Thus, nonwoven fabrics of I/S fibers can be formed, where at least the sea section is separated from island sections to form ultra-fine fibers after formation of the fabric. Alternatively, extruded I/S fibers can be subjected to a dissolving medium prior to forming the bonded nonwoven web of fabric.

In addition to forming nonwoven fabrics as described above, the ultra-fine fibers can be used to form threads and yarns for woven fabrics and other textile products. The ultra-fine fibers can also be cut into smaller, staple fibers.

The system of FIG. 2 can also be modified to include any suitable number of spunbond and/or meltblown beams so as to produce a nonwoven fabric that includes any combination of spunbond and/or meltblown layers, where at least one of the spunbond layers includes ultra-fine fibers formed by dissociation of fiber segments as described above.

Tubular fibers can be constructed utilizing the system of FIG. 2, where the spin pack 118 is configured to form sheath/core I/S fibers having cross-sectional configurations as described above and depicted in FIG. 1B. An exemplary spin pack that includes a suitable polymer distribution plate stacking arrangement for achieving the sheath/core island configuration within a sea section is described in co-owned and commonly assigned U.S. patent application Ser. No. 10/379,382, the disclosure of which is incorporated herein by reference in its entirety. In addition, when utilizing PAN or pitch to form the tubular fibers, the PAN or pitch fibers are subjected to a carbonization process as described above by subjecting the fibers to heat (e.g., in a furnace or chamber) to convert the PAN or pitch fibers to carbon fibers. As noted above, sheath/core island segments can be formed with the sheath sections including PAN or pitch and the core sections including a dissolvable first polymer component or a substantially insoluble second polymer component. Thus, carbon tubular fibers can be formed by carbonization of the PAN or pitch sheath sections with or without the core sections being removed from the sheath sections.

Having described preferred embodiments of new and improved methods and apparatus for forming ultra-fine fibers and non-woven webs of ultra-fine fibers, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A method of forming fibers, comprising:

delivering at least first and second polymer components in a molten state from a spin pack to a spinneret, wherein the first polymer component comprises at least one polymer that is at least partially dissolvable in a dissolving medium and the second polymer component comprises at least one of polyacrylonitrile and pitch; and extruding fibers including the first and second polymer components from the spinneret, wherein at least some of the fibers include islands-in-the-sea fibers, each islands-in-the-sea fiber includes island segments disposed within a sea section, the sea sections of the islands-in-the-sea fibers comprise the first polymer component, and at least some of the island segments comprise sheath-core segments including a sheath section comprising the second polymer component surrounding a core section.

2. The method of claim 1, wherein each of the sheath segments of the islands-in-the-sea fibers have a transverse cross-sectional dimension that is no greater than about 500 nanometers.

3. The method of claim 1, wherein the core sections of the fibers comprise the first polymer component, and the method further comprises: separating the sea sections and core segments from the sheath segments of islands-in-the-sea fibers to form tubular fibers comprising the second polymer component.

4. The method of claim 1, further comprising:

carbonizing at least the second polymer component in the tubular fibers to form carbon tubular fibers.

5. The method of claim 1, further comprising:

separating the sea sections from the island segments of islands-in-the-sea fibers; and carbonizing at least the second polymer component in the island segments.

6. A method of forming fibers, comprising:

extruding fibers including a plurality of different polymers from a spinneret, wherein at least some of the fibers include islands-in-the-sea fibers, each islands-in-the-sea fiber includes island segments disposed within a sea section, the sea sections of the islands-in-the-sea fibers comprise the first polymer component, and at least some of the island segments comprise sheath-core segments including a sheath section comprising the second polymer component surrounding a core section, wherein each of the sea section and the core segments comprises at least one polymer that is at least partially dissolvable in at least one dissolving medium; and dissolving the sea sections and core segments from the sheath segments of islands-in-the-sea fibers to form tubular fibers.

* * * * *

UNITED STATES PATENT AND TRADEMARK OFFICE

CERTIFICATE OF CORRECTION

PATENT NO. : 7,431,869 B2
APPLICATION NO. : 10/860565
DATED : October 7, 2008
INVENTOR(S) : Jeff Haggard et al.

It is certified that error appears in the above-identified patent and that said Letters Patent is hereby corrected as shown below:

Column 10, line 65: delete "core sections of the", and line 66: delete "fibers comprise the first polymer component, and the".

Signed and Sealed this

Twenty-third Day of December, 2008

JON W. DUDAS
*Director of the United States Patent and Trademark Office*